United States Patent [19]

Doner et al.

[11] Patent Number: 4,505,334

[45] Date of Patent: Mar. 19, 1985

[54] BALL SEALER

[75] Inventors: August K. Doner, Elmo; Lewis L. Brady, Plano; Jesse T. Alvarado, Canton, all of Tex.

[73] Assignee: Oil States Industries, Inc., Arlington, Tex.

[21] Appl. No.: 529,951

[22] Filed: Sep. 6, 1983

[51] Int. Cl.[3] ..... E21B 33/13

[52] U.S. Cl. ..... 166/284; 166/193; 156/170

[58] Field of Search ..... 166/284, 193; 273/58 BA, 58 R, 60 R; 428/35, 403, 407; 156/170, 307.1, 307.3

[56] References Cited

U.S. PATENT DOCUMENTS

| | | | |
|---|---|---|---|
| 697,421 | 4/1902 | Kempshall . | |
| 2,081,531 | 5/1937 | Fegan | 273/58 |
| 2,210,954 | 8/1940 | Roberts | 154/16 |
| 2,278,292 | 10/1938 | Voit | 273/58 |
| 2,342,603 | 7/1940 | Ryan | 273/62 |
| 2,754,910 | 7/1956 | Derrick et al. | 166/1 |
| 2,819,573 | 1/1958 | Whittington | 53/7 |
| 2,933,136 | 4/1960 | Ayers | 166/42 |
| 3,010,514 | 11/1961 | Fox | 166/21 |
| 3,132,761 | 5/1964 | Sylvester | 156/170 |
| 3,271,119 | 9/1966 | Woodberry | 428/35 |
| 3,437,147 | 4/1969 | Davies | 166/305 |
| 3,637,446 | 1/1972 | Elliott et al. | 156/170 |
| 4,005,233 | 1/1977 | Dritt et al. | 156/170 |
| 4,102,401 | 7/1978 | Erbstoesser | 166/284 |
| 4,139,060 | 2/1979 | Muecke et al. | 166/281 |
| 4,160,482 | 7/1979 | Erbstoesser et al. | 166/284 |
| 4,187,134 | 2/1980 | Svub et al. | 156/170 |
| 4,244,425 | 1/1981 | Erbstoesser | 166/284 |
| 4,251,073 | 2/1981 | Birdsong | 273/61 |
| 4,333,648 | 6/1982 | Aoyama | 156/170 |
| 4,407,368 | 10/1983 | Erbstoesser | 166/284 |

FOREIGN PATENT DOCUMENTS

| | | | |
|---|---|---|---|
| 1305017 | 1/1973 | United Kingdom . | |
| 2025485 | 1/1980 | United Kingdom | 166/284 |

*Primary Examiner*—Stephen J. Novosad
*Assistant Examiner*—Hoang C. Dang
*Attorney, Agent, or Firm*—Arnold, White & Durkee

[57] ABSTRACT

A ball sealer for use in flow equalization during fluid injection into oil wells is described which has a layer of thermosetting filament wrapped around its core. After curing, the wrapping layer provides the major part of the ball's strength.

12 Claims, 8 Drawing Figures

BALL SEALER

BACKGROUND OF THE INVENTION

This invention relates to ball sealers that are used during fluid injection operations in oil wells.

Oil and gas wells are typically constructed with a vertical underground pipe, or casing, surrounded by a concrete sheath. This structure permits the flow of fluid between the casing and the surrounding formations to be limited to selected zones. The well operator determines which strata he wishes to collect hydrocarbons from or inject fluid in, and then perforates the casing and concrete at that level (or levels).

One operation which is frequently performed on oil wells is the injection of fluids into the surrounding formations. One specific example of a fluid injection operation is hydraulic fracturing. In this operation, a fluid such as water which contains particulate material such as sand is pumped down from the surface into the casing and out through the perforations into the surrounding formations. The particulates lodge in tiny cracks in the target formations and serve to "prop" those cracks open. This increases the permeability of the formation and therefore increases the flow of hydrocarbons into the well when fluid injection ceases.

In order to maximize the beneficial effect of an operation like hydraulic fracturing, it is important that the fluid be injected into the surrounding formations with a fairly even flow distribution in all directions. However, achieving an even distribution can be difficult, because the formations surrounding the perforated zone may not be of equal permeability. The fluid will preferentially flow to the areas of least resistance, i.e. the areas of highest permeability, and low permeability areas will receive correspondingly reduced flow rates. This problem can become especially acute when the perforated zone is long or there are a number of different perforated zones.

One method of attacking this flow imbalance problem involves the use of spherical ball sealers. These ball sealers have a diameter slightly larger than the average perforation size, and are pumped into the casing along with the treating fluid. The flow pattern of the fluid preferentially carries the ball sealers toward the casing perforations which have the highest flow rates of fluid passing into the surrounding formations. If a substantial number of the ball sealers seat against the high flow perforations, then fluid flow through those openings is blocked. The perforations which had relatively low flow rates before are now forced to receive the diverted flow. By thus redirecting at least some of the fluid toward the formations with the greatest resistance to flow, a more even flow distribution can be achieved. As a result, the increase in hydrocarbon recovery is larger than it would be if the flow imbalance was not corrected.

If a ball sealer has a greater specific gravity than the fluid injected, the force of gravity pulling down on the ball will be greater than the upward buoyant force. Therefore the ball will sink in a stagnant body of the fluid. When the additional downward drag force exerted on the ball by the downwardly flowing fluid is taken into account, the ball's downward velocity obviously becomes relatively high. This relatively high downward velocity can cause some of the balls to overshoot the perforated zone and sink to the bottom of the well. U.S. Pat. Nos. 4,102,401 and 4,244,425, both to Erbstoesser, teach the use of ball sealers which have a specific gravity less than that of the injected fluids. Balls with lower specific gravity will have a net velocity, considering the gravitational and buoyant forces only, that is upward, not downward like denser balls. Therefore, when the downward drag force exerted on the ball by the fluid is taken into account, the ball's downward velocity will be substantially less than if it had a higher specific gravity.

Reducing the ball's downward velocity reduces the chance that it will overshoot the perforated zone. Further, even if a ball does overshoot, the fluid beneath the perforated zone is stagnant so that ball experiences no downward drag force in that region. Thus, balls that do overshoot will rise back into the perforated zone. Because low specific gravity balls will not sink to the well bottom where they cannot help redistribute flow, they are usually more effective in combatting this problem than are denser balls.

Although ball sealers have proven useful for reducing flow imbalances, several problems remain in their use. First, the ball sealers must operate in an hostile environment. When seated against a perforation, a ball sealer usually experiences a large pressure differential between the fluid in the casing and the fluid in the surrounding formation. In addition, the temperature in the well during fluid injection operations is frequently high. Ball sealers tend to undergo heat distortion under these conditions. When the spherical shape of a ball sealer distorts, its strength is significantly reduced and failure is much more likely. If too many of the injected ball sealers fail, the desired flow correction cannot be achieved.

Further, some prior art ball sealers have presented manufacturing problems. Some balls made of "syntactic foam" (hollow spherical particles dispersed in some kind of binder) tend to crystallize when they are cured. The crystallization affects the overall specific gravity of the ball. Since this property is important to the ball's operation, crystallization causes an undesirably high percentage of rejects in the manufacture of syntactic foam balls.

In addition, there remains a need for ball sealers which can withstand even greater temperature and pressure than the balls currently in use.

SUMMARY OF THE INVENTION

A ball sealer in accordance with the present invention includes a spherical core which forms a suitable base on which to wrap a filament, and a layer of thermosetting filament wrapping outside the core which is sufficiently thick to give the ball sealer the strength necessary to withstand the pressure differential across a perforation in oil well casing during fluid injection. The ball sealer can optionally have a layer of a resinous polymer outside the wrapping layer, an elastomeric outer covering, or both. Further, the core can be hollow or solid.

The filament wrapping has a significant effect on the ability of the ball sealer to resist heat distortion and retain its spherical shape. Therefore, the ball exhibits an improved ability to resist failure under the high temperatures and pressures that exist in oil wells during fluid injection operations. Even greater strength can be achieved if the thermosetting filament is impregnated with reenforcing particles or fibers.

A ball sealer in accordance with the present invention can be manufactured by winding the filament around the core to form a wrapping layer, applying a compressive force to the wrapping layer, and then curing the ball. Additional outer layers can be formed on the ball, as described above.

DETAILED DESCRIPTION OF A SPECIFIC EMBODIMENT

Figure 1:
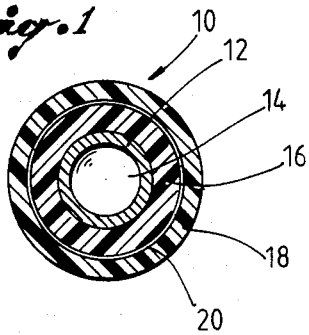
FIGS. 1, 2 and 2A show ball sealers in accordance with the present invention.

A ball sealer 10 in accordance with the present invention is shown in FIG. 1. The ball sealer 10 includes a core 12 which has a hollow center 14, a layer of filament wrapping 16, and an elastomeric outer covering 18. The wrapping layer 16 consists of a filament wrapped in a regular pattern around the core 12. The ball sealer 10 can also include a thin coating of an adhesive 20 between the wrapping layer 16 and the elastomeric covering 18 to attach the covering 18 more securely to the rest of the ball sealer 10.

Figure 2:
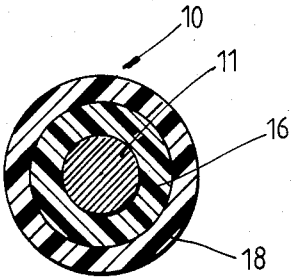

Alternatively, the ball sealer 10 can have a solid core 11, as shown in FIG. 2. If a solid core 11 is used, the ball sealer 10 will of course have a higher overall specific gravity than a hollow core ball made of the same materials. A specific gravity lower than that of the injected fluids can still be achieved by proper selection of materials. For example, if the core consists of some continuous binder with a dispersion of hollow spherical particles, the ball will have a low overall specific gravity. This type of material has been referred to as "syntactic foam". Other suitable core materials (hollow or solid) include nylon, aluminum, and resinous polymers.

Figure 2A:
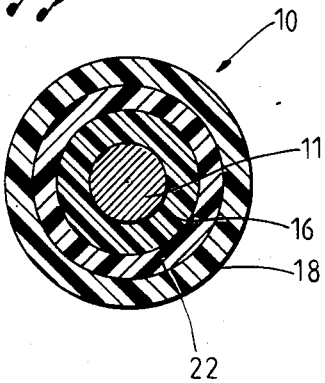

FIG. 2A shows another ball 10 in accordance with the present invention. In addition to having a solid core 11, a wrapping layer 16, and an elastomeric covering 18, this ball additionally includes a resinous polymer layer 22 between the wrapping layer 16 and the elastomeric covering 18. There have been some indications in preliminary testing that adding this layer may improve the adhesion of the elastomeric cover 18 to the rest of the ball. This layer of resinous polymer 22 can also be used with a hollow core ball, and phenolic resins are an example of a suitable material. Alternatively, the layer of resinous polymer 22 can be used without an elastomeric layer 18.

Figure 3:
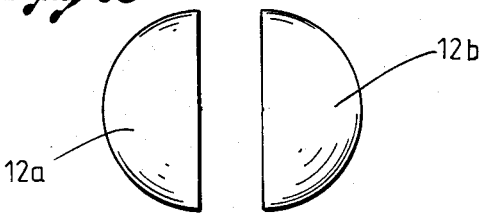
FIG. 3 shows a hollow core molded in two halves in accordance with the present invention.

FIG. 3 shows the first step in the manufacture of a ball sealer in accordance with the present invention. If the core is to be hollow, it can be molded in two hemispherical halves **12*a* and 12*b* which are then bonded together. Since the primary purpose of the core 12 is to form a base for the winding layer, it need not necessarily be designed so it will provide strength when the ball is in operation in a well. Therefore, almost any moldable material will be suitable for the core 12. One material that has been found satisfactory is polystyrene. Polystyrene cores have been found to melt and crumple in some instances from the heat of the curing step or the heat experienced in the well. However, once the wrapping layer is completed as described below, the core 12** does not necessarily need to make any contribution to the ball sealer's strength.

Figure 4:
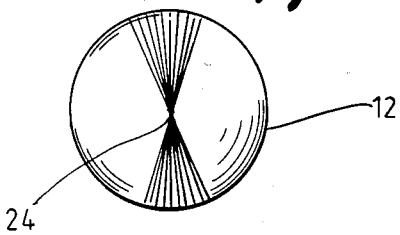
FIG. 4 shows a filament being wrapped around a core in accordance with the present invention.

After the core halves **12*a* and 12*b* are bonded together, a filament 24 is wound in a regular pattern around the core 12, as shown in FIG. 4. The first end of the filament can be attached to the core with a drop of an adhesive material, such as quick drying cement available from Lucite. The filament 24** should be wrapped in a regular geometric pattern, rather than a random one, because the former will give the ball sealer greater strength.

The filament 24 should consist essentially of a thermosetting material, because when the ball is in operation the wrapping layer must provide the greatest part of the ball's strength. One example of a suitable filament is Fiberite FX440A sold by Fiberite Corporation, Winona, Minn. This filament is reenforced with particles or fibers of graphite, which give it even greater strength.

After the wrapping is complete, a liquid adhesive binder can optionally be applied. One suitable binder is Karbon 472, sold by Fiberite Corporation. Karbon 472 has generally the same composition as the graphite reenforcing particles in FX440A. When applied to the wrapping layer, it helps make that layer a cohesive mass. The binder can be applied by spraying, painting, or dipping.

Figure 5:
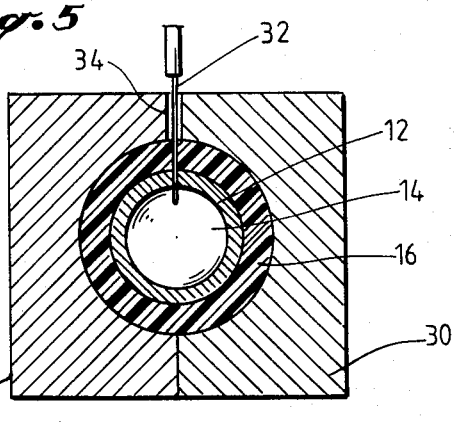
FIG. 5 shows a partially finished ball sealer undergoing blow-compression molding in accordance with the present invention.

After the wrapping is complete, the next step is to compress the wrapped filament, as shown in FIG. 5. Compression can be applied by a spherical mold consisting of two halves, **30*a* and 30*b*, which have a spherical center opening with a diameter slightly less than the diameter of the wrapping layer 16. Thus, when the mold halves 30*a* and 30*b* are brought together around the partially formed ball sealer, the wrapping layer 16** is placed in compression.

It is preferable to pressurize the hollow core 14 of the ball sealer at the same time in order to compress the wrapping layer 16 between external and internal forces. This can be accomplished by a needle 32. The needle 32 is inserted through an aperture 34 in the mold, penetrating into the hollow center 14 of the ball. Pressurized gas can be forced into the hollow center 14 through the needle 32 from an external source. The compression step can suitably last for about 2 minutes for hollow core balls, and be carried out at a temperature of about 350° F. For solid core balls the compression step can continue for about 6 minutes at 350° F.

Figure 6:
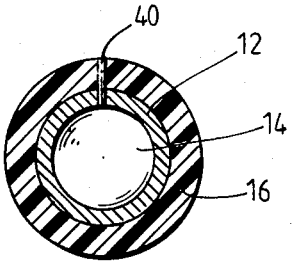
FIG. 6 shows a ball in accordance with the present invention immediately after the step shown in FIG. 5 ends.

After the needle 32 is removed, a hole 40 is left in the wrapping layer 16 and core 12, as shown in FIG. 6. The hole 40 can be sealed with a thermosetting resin before the manufacturing process continues.

In solid core balls, application of compressive forces on the wrapping layer from both the inside and outside can be achieved by constructing the core of a material which expands under the temperatures experienced in that step.

The ball is next cured in an oven. For hollow core balls curing can last for about 4 hours at approximately 425° F. Solid core balls are usually left at room temperature for about 15 minutes before being placed in the oven. They are held at a temperature of about 125° F. for 1 hour, and the temperature is then increased at a rate of 10°-15° F. per minute until a maximum temperature of about 485° F. is reached. Total oven time for solid core balls can suitable be about 4 hours. During this period, the filament 24 in the wrapping layer 16 sets, forming a hard, strong, sperical layer.

The ball sealer can be used without further processing. However, it is often desirable to mold an elastomeric outer cover 18 around the ball, as depicted in FIG. 1. A coating of an adhesive material 20 can also be used to improve the cohesiveness of the ball as a whole.

In addition, it is possible to mold a layer of a resinous polymer (for example, a phenolic resin) between the wrapping layer and the elastomeric cover, as discussed above. This layer of resinous polymer can be used with or without an elastomeric covering, and can be used for either solid core or hollow core balls.

The present invention is not limited to specific sizes or densities. However, the following is a representative example of the dimensions and weight of a ball sealer in accordance with the present invention. The hollow core can have an outer diameter of 0.608 inches, and therefore an outer radius of 0.304 inches. Since the wall thickness of the hollow core is very small, its weight can be essentially disregarded for the purpose of calculating the overall specific gravity of the ball. The filament can be wrapped around the core until an outer diameter of 0.75 inches is reached. This will give the wrapping layer an outer radius of 0.375 inches and an inner radius of 0.304 inches, or a wall thickness of 0.071 inches. If the net specific gravity of the wrapping layer is 1.54, the wrapping layer will weigh 2.60 grams. The elastomeric outer covering makes the overall outer diameter of the ball $\frac{7}{8}$ of one inch. Thus, the elastomeric covering will have an outer radius of 0.4375 inches and an inner radius of 0.375 inches, making its wall thickness 0.063 inches. If the specific gravity of the elastomeric material is 1.13, the weight of the elastomeric layer will be 2.40 grams. Therefore, the total weight of the ball will be 5.0 grams. Since the volume of a ball with a $\frac{7}{8}$ inch outer diameter is 5.75 cubic centimeters, the overall specific gravity of the ball will be 0.87.

Figure 7:
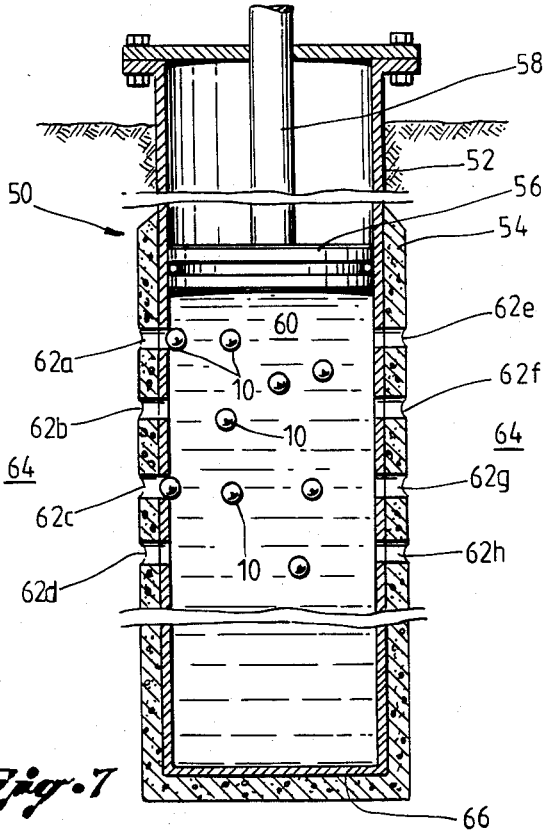
FIG. 7 shows ball sealers being injected into an oil well along with treating fluids.

FIG. 7 shows several ball sealers 10 being injected into an oil well 50. The well 50 includes a casing 52 and a surrounding concrete sheath 54. Often a production packer 56 is installed at the lower end of a production tubing 58. The injected fluids 60 are pumped from the surface through the production tubing 58. If a production tubing 58 and packer 56 are not used, the entire interior volume of the casing 52 is used to convey fluids to or from the surface.

The casing 52 and concrete 54 contain a number of perforations 62 which connect the interior of the well 50 with the surrounding formations 64. During production, hydrocarbons flow from the formations 64 through the perforations 62 into the well 50, and then up to the surface. When fluids 60 are injected during operations like hydraulic fracturing, the direction of flow is reversed.

The ball sealers 10 are injected with the fluids 60. Ball sealers 10 with a specific gravity less than that of the fluids 60 will sink at a relatively low velocity even when the fluid 60 is flowing downward and exerting a drag force on them. Given the composition of common treating fluids, an overall ball sealer specific gravity of 0.85 to 0.95 is usually desirable.

Therefore, during fluid injection the ball sealers 10 will be carried downward toward the perforation 62. However, if a ball sealer 10 sinks below the lowest perforations, **62*d* and 62*h*, it will rise since the fluid below that level is generally stagnant and will not exert any downward drag force on it. Thus, balls 10 with specific gravities less than that of the fluid 60 will not sink to the bottom 66 of the well 50**.

When the ball sealers 10 reach the vicinity of the perforations 62, the flow of the fluid 60 outward through the perforations 62 will force the ball sealers 10 in that direction. If the surrounding formations 64 are not of uniform permeability, the fluid 60 will flow at a higher rate through apertures which are adjacent to the formations with the highest permeability. Thus, the fluid velocity will be highest through these high flow perforations, and the ball sealers 10 will be preferentially forced toward those particular perforations.

In FIG. 7, perforations **62*a* and 62*b* are assumed to be the perforations experiencing the highest flow rates, so the ball sealers 10 preferentially move towards them and ultimately seat on them. As a result, the fluid 60 is redirected through the other perforations 63*c*–*h* which are adjacent to formations 64** with lower permeabilities.

It should be noted that an oil well is likely to have many more perforations than the eight shown in FIG. 7. Of this large number of perforations, some would be classified as high flow, some as moderate flow, and others as low flow. Ball sealers 10 will not seat against every high flow perforation. However, the percentage of high flow perforations which will be sealed will be greater than the percentage of moderate flow perforations sealed, which in turn will be greater than the percentage of low flow perforations sealed. In this way, the desired overall even distribution of flow is achieved. ("Even distribution" is used in this specification and in the claims that follow to mean a flow distribution that is not necessarily exactly equal in all directions, but is substantially more even than in its uncorrected state.)

Ball sealers constructed in accordance with the present invention have shown a significantly improved ability to resist the high pressure differentials that exist between the wall 50 and the surrounding formations 64. In addition, their ability to maintain their spherical shape and thereby resist failure has been demonstrated under the high temperatures which are often present during fluid injection operations. Further, ball sealers in accordance with the present invention can be manufactured with a lower percentage of rejects than some prior art balls. The following examples illustrate that although some problems remain with the elastomeric outer covering, ball sealers in accordance with the present invention display the advantages listed above.

EXAMPLE 1

A test apparatus was constructed which contained an aperture resembling a perforation in oil well casing. Means were provided to pump water into the apparatus and create a pressure differential across a ball sealer seated on the aperture. Means were also provided for elevating the water temperature.

This test was conducted with a hollow core ball which has a specific gravity of approximately 0.9. The elastomeric outer cover had a smooth appearance. The test was begun with a 6,000 psi pressure differential and a water temperature of 300° F. These conditions were maintained for 4 hours, when the heating means was disconnected for safety-related reasons. The pressure was maintained for an additional 2 hours. After 14 hours of depressurizing the vessel, the apparatus was opened, and the ball sealer unseated without assistance.

The rubber covering displayed a ring-shaped indentation where the ball had been seated against the aperture. When pressure was applied with a thumb nail into this dent, a crackling sound was heard. The wrapping layer was apparently somewhat weakened at this point only. The ball still floated on water, indicating that its specific gravity had not increased over 1.0.

EXAMPLE 2

A ball similar to the one used in Example 1 was tested at 5,000 psi and 265° F. The ball failed after 45 minutes at these conditions. Forty (40) psi of back pressure was required to dislodge the ball from the aperture.

The rubber covering displayed a cut two-thirds of the way around the ring-shaped indentation where the ball had sealed. The rubber covering in this cut area could be lifted like a flap. The ball weighed 6.494 grams, compared to 5.424 grams before the test began, indicating that a substantially amount of moisture had entered the ball. It would not float on water.

EXAMPLE 3

A ball with a weight of 4.574 grams, a specific gravity of approximately 0.9, and some small bubbles in its rubber covering was placed in the apparatus and was attempted to be seated at a 1.500 psi differential without the application of any external heat. The ball was not successfully seated, and when removed showed a dent in the rubber covering where the ball contacted the aperture. The ball also had four large blisters which were apparently filled with water. The ball weighed 6.255 grams when removed, and would not float. After baking for 45 minutes, its weight had been reduced to 6.116 grams, but it still would not float.

EXAMPLE 4

A ball was constructed with a core weight of 2.63 grams, an elastomeric covering consisting of 402-50 rubber, and an overall specific gravity of 0.8752. The rubber covering contained some slight air pockets. The ball was subjected to 4,000 psi and 200° F., and failed after 30 minutes. When examined, the rubber covering was completely cut away from the ball in the area where it had been seated. The rubber thickness at this point measured 0.016 inches, instead of the desired 0.062 inches, indicating that the ball had "floated" when the rubber covering was being molded on it. Cutting the ball in half revealed that the rubber covering did not adhere to the rest of the ball to any appreciable extent. The wrapping layer's wall thickness was found to measure between 0.062 inch and 0.075 inch.

EXAMPLE 5

A ball was constructed with a core weight of 2.6247 grams, a rubber covering made of 4X31 rubber, and an overall specific gravity of 0.8623. This ball was subjected to a pressure differential of 3,500 psi and a temperature of 212° F., but failed after 9 minutes. The rubber was cut through to the core three-fourths of the way around the seat area. The rubber covering had been forced into the seat area, causing it to take a cone shape. In addition, water had been forced between the rubber and the rest of the ball. The ball would not float, and 40 psi of air pressure was required to release it from the seating aperture.

EXAMPLE 6

A ball was constructed with a core weight of 2.8304 grams, a rubber covering consisting of 4X31 rubber, and a specific gravity of 0.9261. This ball was seated at 2,000 psi after several unsuccessful tries. The ball failed after 10 minutes at 3,500 psi and 212° F.

The rubber covering had been cut half the way around the seat area, and this created a rubber "flap" which could be lifted, There appear to be no adhesion of the cut rubber area to the rest of the ball. However, no water apparently entered the ball, because it would still float on water. The rubber thickness at the cut flap area measured 0.022 inches, showing that once again the ball had "floated" while the elastomeric covering was being molded.

EXAMPLE 7

A ball with weight of 7.190 grams, a specific gravity of 0.879, and a rubber covering whose surface exhibited some small bubbles, was tested. The ball was seated at 3,400 psi. The pressure was increased to 6,000 psi and the temperature increased to 300° F. After approximately three and one-half hours, the temperature control failed, causing the water temperature to reach 360° F. The pressure indicator began to fluctuate between 5,400 and 5,500 psi, and did not reach 6,000 psi again. The test was stopped after a total of 4 hours, and the ball was released with 80 psi air pressure.

The ball showed a dent in its rubber covering where it had been seated. Water had broken into some of the bubbles and leaked between the rubber and the inner part of the ball, and this apparently caused the pressure to drop. Even so, the ball would still float on water, and had a weight of 8.060 grams and a specific gravity of 0.09823. It appears that the temperature runaway in this test may have been responsible for the failure.

EXAMPLE 8

A ball was constructed which had a weight of 4.70 grams, a specific gravity of 0.8623, and a rubber covering with some small bubbles. The ball seated at 2,800 psi, with a temperature of 300° F. The pressure was increased to 6,400 psi, then reduced to 6,000 psi. This pressure was maintained for about 4 hours and 35 minutes, when the pressure again began to fluctuate between 5,400 and 5,600 psi. The test was stopped after ten more minutes, and the ball released with the application of 90 psi of back pressure.

The wrapping layer was exposed by a deep cut in the rubber, but no internal damage appeared to have been done. The adhesive material appeared not to have succeeded in joining the covering to the wrapping layer. However, the ball would still float in water, and had a specific gravity of 0.9790. It is possible that the high pressure of 6,400 psi caused a small cut in the rubber which eventually caused the failure after 4 hours and 45 minutes of testing.

EXAMPLE 9

A ball was constructed with a weight of 7.59 grams, a specific gravity of 0.9261, and a rubber covering which showed a few small bubbles. The ball was seated at 2,800 psi, and the pressure was increased to 6,000 psi at a temperature of 300° F. The pressure suddenly dropped after 1 hour and 15 minutes, and the ball was released with 40 psi of back pressure. The rubber covering had been cut away from the seated area. Again, the apparent cause for the failure was the lack of adhesion of the covering to the rest of the ball.

EXAMPLE 10

A ball was constructed with a weight of 4.582 grams, a specific gravity of 0.852, and a rubber covering which had slightly larger bubbles than the ball in Example 9. The ball was seated at 3,300 psi and 300° F. The ball went off the seat, and the pressure dropped to 1,500 psi. When the pressure was increased once again, the ball reseated at 2,900 psi. The pressure was then increased to 6,000 psi and held at that level for 3 hours, when there was a sudden failure. The ball released from the aperture when 60 psi of back pressure was applied.

There were two dents in the rubber covering in the form of a figure eight, obviously reflecting the two separate locations where the ball had seated. One of these dents was a cut that reached the wrapping layer, and it appeared that the adhesive did not hold at this point.

It is apparent from these examples that although some problems remain with the elastomeric outer covering and the adhesive which holds it to the rest of the ball, the wrapping layer composed of a thermosetting filament has been shown to exhibit improved strength and to resist distortion of its spherical shape.

The preceding has been a description of a few particular embodiments of the present invention and test performed on some of those embodiments. It has not been intended as an exhaustive list of all possible embodiments. Those skilled in the art will appreciate that modifications could be made to the embodiments discussed above which would remain within the scope of the general concept disclosed.

What is claimed is:

1. A ball sealer for seating against high flow perforations in oil well casing during fluid injection, comprising:

a spherical core which forms a suitable base on which to wrap a filament; and a layer of thermosetting filament wrapping outside the core which is sufficiently thick to give the ball sealer the strength necessary to withstand the pressure differential across a perforation in oil well casing during fluid injection.

2. The ball sealer of claim 1, wherein the core consists essentially of a material selected from the group consisting of nylon, aluminum, syntactic foam, and resinous polymers.

3. The ball sealer of claim 1, further comprising an elastomeric outer covering.

4. The ball sealer of claim 3, further comprising a layer of a resinous polymer between the wrapping layer and the elastomeric outer covering.

5. The ball sealer of claim 1, wherein the core is solid and consists essentially of a material that expands when heated.

6. The ball sealer of claim 1, wherein the core is hollow.

7. The ball sealer of claim 6, wherein the overall specific gravity of the ball is between 0.85 and 0.95.

8. The ball sealer of claim 7, wherein the filament is a graphite-carbon impregnated thermosetting filament.

9. The ball sealer of claim 8, further comprising an elastomeric outer covering, wherein the core consists essentially of polystyrene.

10. A system for injecting fluids into a formation surrounding an oil well with an even distribution, comprising:

a casing which includes a plurality of perforations;

means for pumping fluids into the casing; and a plurality of ball sealers which are pumped into the casing with the fluids, a substantial number of which seat against the casing perforations through which the highest flow rate is passing, each ball sealer including:

a spherical core which forms a suitable base on which to wrap a filament; and a layer of thermosetting filament wrapping outside the core which is sufficiently thick to give the ball sealer the strength necessary to withstand the pressure differential across a perforation in oil well casing during fluid injection.

11. The system of claim 10, wherein the ball sealers further include an elastomeric outer covering, and have a specific gravity between about 0.85 and 0.95 and a hollow core.

12. A ball sealer for seating against high flow perforations in oil well casing during fluid injection, comprising:

a spherical core which forms a suitable base on which to wrap a filament;

a layer of graphite-carbon impregnated thermosetting filament wrapping outside the core which is sufficiently thick to give the ball sealer the strength necessary to withstand the pressure differential across a perforation in oil well casing during fluid injection;

an adhesive binder included in the wrapping layer;

a layer of resinous polymer outside the wrapping layer; and an elastomeric layer outside the layer of resinous polymer.

* * * * *

UNITED STATES PATENT AND TRADEMARK OFFICE

CERTIFICATE OF CORRECTION

PATENT NO. : 4,505,334
DATED : March 19, 1985
INVENTOR(S) : August K. Doner, et al It is certified that error appears in the above-identified patent and that said Letters Patent is hereby corrected as shown below:

Column 5, line 2 delete "suitable" and insert --suitably--.

Column 6, line 40 delete "wall" and insert --well--.

Column 8, line 10 after lifted delete "," and insert --.--.

Signed and Sealed this

*Thirteenth* Day of *August 1985*

[SEAL]

*Attest:*

DONALD J. QUIGG

*Attesting Officer* *Acting Commissioner of Patents and Trademarks*